US007802319B2

(12) United States Patent
Shaver

(10) Patent No.: US 7,802,319 B2
(45) Date of Patent: Sep. 28, 2010

(54) HELMET WITH REARWARD ACCESS APERTURE

(76) Inventor: Sheila Shaver, 1530 E. Main St., Peninsula, OH (US) 44264

( * ) Notice: Subject to any disclaimer, the term of this patent is extended or adjusted under 35 U.S.C. 154(b) by 885 days.

(21) Appl. No.: 11/493,785

(22) Filed: Jul. 26, 2006

(65) Prior Publication Data

US 2008/0022442 A1 Jan. 31, 2008

(51) Int. Cl.
*A42B 1/06* (2006.01)
*A63B 71/10* (2006.01)

(52) U.S. Cl. ..... 2/410; 2/425

(58) Field of Classification Search ..... 2/410, 2/417, 422, 425, 171, 184.5, 175.3, 209.3, 2/209.4; 132/60, 65.1, 270, 273, 54
See application file for complete search history.

(56) References Cited

U.S. PATENT DOCUMENTS

| | | | | |
|---|---|---|---|---|
| 2,140,716 | A | 12/1938 | Pryale | |
| 2,253,538 | A | 8/1941 | Sirch | |
| 3,060,933 | A | 10/1962 | Hellquist | |
| 3,925,821 | A | 12/1975 | Lewicki | |
| 3,973,588 | A | 8/1976 | Holst | |
| 4,075,717 | A | 2/1978 | Lemelson | |
| 4,081,865 | A | 4/1978 | Bergee et al. | |
| 4,998,544 | A * | 3/1991 | Obergfell | 132/212 |
| RE34,699 | E | 8/1994 | Copeland et al. | |
| 5,477,565 | A | 12/1995 | Junt, Jr. | |
| 5,535,454 | A | 7/1996 | Ryan | |
| 5,666,670 | A | 9/1997 | Ryan et al. | |
| 5,937,446 | A | 8/1999 | Fallert | |
| 6,792,623 | B2 | 9/2004 | Luppi | |
| 2006/0075543 | A1 * | 4/2006 | Shaver | 2/410 |

* cited by examiner

*Primary Examiner*—Gary L Welch
*Assistant Examiner*—Amber R Anderson
(74) *Attorney, Agent, or Firm*—Brouse McDowell; John M. Skeriotis

(57) ABSTRACT

A safety helmet for protecting a user head includes a shell extending about the perimeter of the user's head. The shell has multiple layers of material suitable for protecting a person's head in the event of a crash or other impact. A front opening is formed in the shell to allow the user to see while wearing the helmet. A separate access opening is included at the rear of the helmet, which includes a channel member extending through the multiple layers.

8 Claims, 6 Drawing Sheets

65

HELMET WITH REARWARD ACCESS APERTURE

I. BACKGROUND OF THE INVENTION

A. Field of Invention

This invention pertains to the art of methods and apparatuses of safety helmets and more specifically access holes in the safety helmet and methods and apparatuses for facilitating use of such helmets.

B. Description of the Related Art

It is well known in the art to provide a helmet for protecting a person's head. Helmets may take many forms, such as a hard hat for use in construction and other areas. Another usage of helmets may pertain to operating a motorized vehicle, such as a car or motorcycle. Still other uses may include wearing safety helmets while operating a bicycle, skateboard or other wheeled device. In this manner, helmets are known to protect a person from injury.

One aspect of helmet usage relates to a person's hair and in particular to hair having a relatively long length. Typically, the operator or user of the helmet may pin up their hair if they know that they will be using a helmet. Others may simply allow their hair to extend out from the bottom of the helmet. This can create an undesirable situation as when the operator, for example, is operating a motorcycle. The wind created by movement of the motorcycle may cause the person's hair, extending from beneath the helmet, to be blown wildly about. While it is known to provide helmets having apertures or holes through which long hair can be passed so as to extend outside the helmet surface, there is still need for apparatus and methods for assisting the associated user in passing his or her hair through the aperture in the helmet The subject invention addresses difficulties in passing hair, namely a ponytail, through a helmet having an aperture for receiving the ponytail.

II. SUMMARY OF THE INVENTION

One aspect of the helmet for use in protecting a person's head from injury during impact may comprise: a helmet shell having an outer and an inner surface, the helmet shell having an inner core positioned between the outer surface and the inner surface, the helmet shell having a frontal portion and a rearward portion, the helmet shell having a first opening for use in fitting the helmet over an associated person's head, the helmet shell having a front visual access section fashioned at the frontal portion of the helmet shell for use in allowing the associated user to see out from the helmet shell, and, wherein the helmet has an aperture fashioned in the rearward portion extending from the inner surface to the outer surface of the helmet shell.

Another aspect is an apparatus for facilitating the passage of hair through the aperture, comprising a flexible tube having first and second ends, at least the first end of the flexible tube adapted to fit over the associated user's hair and the second end adapted to fit through the aperture and be removably secured onto a fixture positioned adjacent the aperture on the outer surface of the helmet shell.

According to another aspect, the flexible tube comprises elastic band members at the each of the first and second ends of the flexible tube.

According to another aspect, the flexible tube is a flexible, elastic tube.

According to another aspect, the flexible tube is a nylon tube.

According to another aspect of the invention, a method of facilitating the passage of long hair through a helmet having an aperture fashioned in the rearward portion extending from the inner surface to the outer surface of the helmet shell includes placing the first end of the flexible tube over an associated user's hair, and more specifically, ponytail, so that the user's ponytail is substantially inside the tube; placing the second end of the tube through the aperture of the helmet; placing the helmet on the associated user's head; and pulling on the second end of the tube to draw the enclosed ponytail through the aperture.

According to another aspect, the method further includes the step of removably securing the second end of the tube to a fixture positioned adjacent the aperture on the outer surface of the helmet shell after the step of placing the second end of the tube through the aperture of the helmet.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
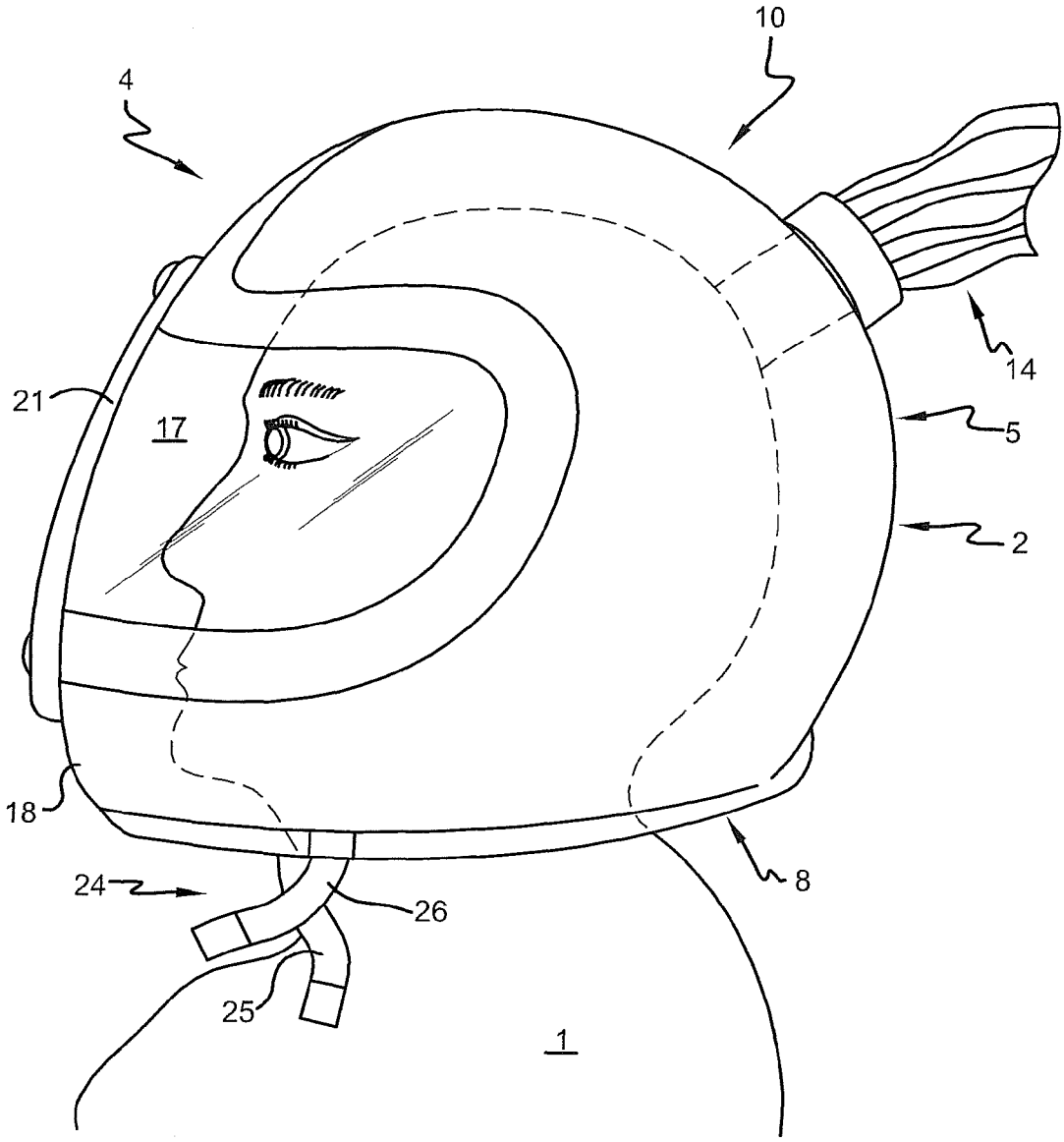
FIG. 1 is a side view of a helmet and associated user.

Referring now to the drawings wherein the showings are for purposes of illustrating a preferred embodiment of the invention only and not for purposes of limiting the same, FIG. 1 depicts an associated operator 1 wearing a helmet shown generally at 2. The helmet 2 may be used in conjunction with operating a motorized vehicle, such as a motorcycle, automobile, bi-cycle and the like. But its use is not to be limited to vehicles. Rather, the subject invention can be used in any situation requiring protection of an operator head.

With continued reference to FIG. 1, the helmet 2 may be contoured to fit over the operator's head 1. While any configuration of helmet may be chosen, in the present embodiment, the helmet 2 may have a generally flat bottom 8 and a curved top portion 10. The interior 11 of the helmet 2 may also be fashioned so as to conform to a person's head. It any case, the novelty of the present invention is not limited by the shape of the helmet 2. The helmet 2 may also have a front portion 4 and a rear portion 5. At the rear 5 of the helmet 2, the aperture 14 may be fashioned in the shell of the helmet 2 as will be discussed further in a subsequent paragraph. It is noted that the aperture 14 may be fashioned in the shell on the sides or the top of the helmet. In fact, the aperture 14 may be fashioned at any location on the helmet.

Figure 2:
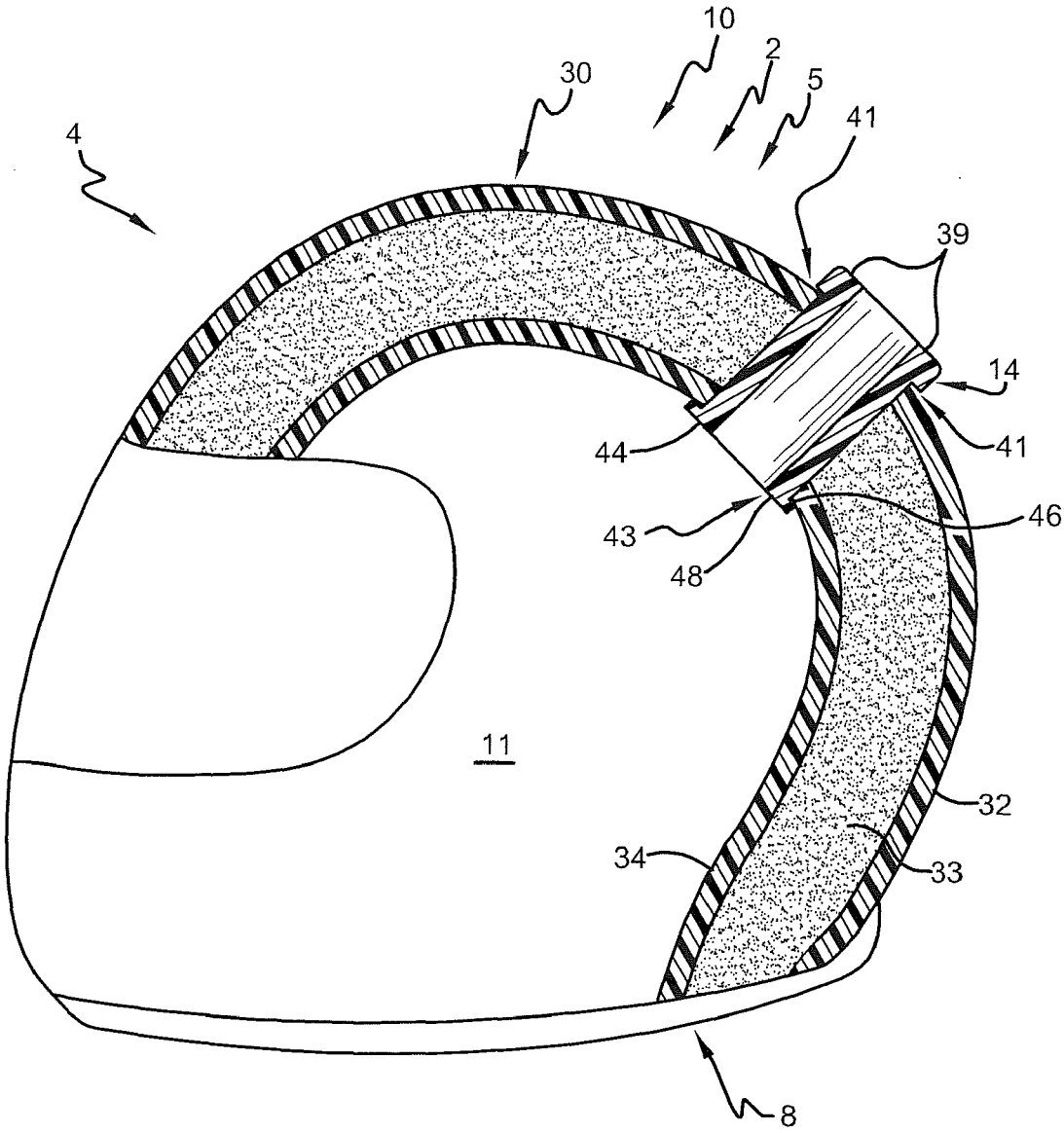
FIG. 2 is a cutaway view of a helmet with rearward aperture.

With continued reference to FIGS. 1 and 2, at the front portion 4, the helmet 2 may include an opening 17 or viewing area 17 for allowing the operator to see out from the helmet 2 during use. In one embodiment, the helmet 2 may include a lower front portion 18 covering the chin of the operator. However, it is also contemplated in another embodiment that the helmet may be devoid of a front portion 18 covering the chin. In any case, the helmet 2 includes a viewing area 17 for allowing the operator to see while using the helmet 2. The helmet 2 may also include face shield 21, which may cover the viewing area 17. The face shield 21 may be removably attached to the helmet 2 in any manner chosen with sound engineering judgment. In one embodiment, the face shield 21 may be constructed from a transparent material. Alternately, the face shield 21 may be darkened to limit the sun and ultra violet rays from penetrating the face shield 21. The material from which the face shield 21 is constructed may be, but is not limited to, plastic and/or other polymers.

With reference again to FIG. 1, securing means 24 or a securing strap may be incorporated onto the helmet 2. The securing means 24 may be constructed from any material chosen with sound engineering judgment to appropriately hold the helmet 2 in place during use. The securing means 24, which may be chin straps 24, may include first and second portions 25, 26 having respective ends that may be fixedly connected to the helmet 2. The first and second portions 24, 25 of the securing means 24 may be selectively fastened together after the helmet 2 has been placed onto the user's head. It is noted that the subject invention is not to be limited by the manner of securing the helmet to the operator's head. In that the use of securing means is well known in the art, no further explanation will be offered at this time.

With continued reference to FIG. 1 and now to FIG. 2, the helmet 2 may include a shell, depicted generally at 30. In one embodiment, the shell 30 may include an outer shell portion 32, a center shell portion 33 and an inner shell portion 34. The outer shell portion 32 may be constructed from a rigid material. The center shell portion 33 may be constructed from hard foam. Similarly, the inner shell portion 34 may also be constructed from foam. However, the foam may be softer foam layer as is juxtaposed to the operator's head. It is noted that any material may be used to form the layers of the shell 30 as chosen with sound engineering judgment.

With reference to all of the FIGURES, an aperture 14 may be fashioned in the shell 30 of the helmet 2. In one embodiment, the aperture 14 may extend from the interior of the helmet space, through the shell layers and to the exterior of the helmet 2. The aperture may be substantially circular in configuration. However, any shape and/or configuration of aperture 14 may be chosen with sound engineering judgment. As mentioned previously, the aperture 14 may be fashioned in the rear 5 of the helmet 2. However, the aperture may be fashioned at any location on the helmet 2. Continuing, a channel member 39 may be received by the aperture 14. The channel member 39 may include a flange portion 41, which may have a larger circumference than the aperture 14. In this manner, the flange portion 41 may prevent the channel member from moving into the helmet 2. Separately, the distal end 43 of the channel member 39 may be threaded 44 to receive a selectively removable securing ring 46 having mating threads 48. This may prevent the channel member 39 from moving out of the helmet. Any manner of affixing a channel member 39 to the helmet 2 may be chosen with sound engineering judgment. It is noted that the channel member 39 may be integrally fashioned with the helmet shell 30 and may not be a separate distinct member. Still, any manner of creating a channel in the helmet 2 may be chosen with sound engineering judgment.

Figure 3:
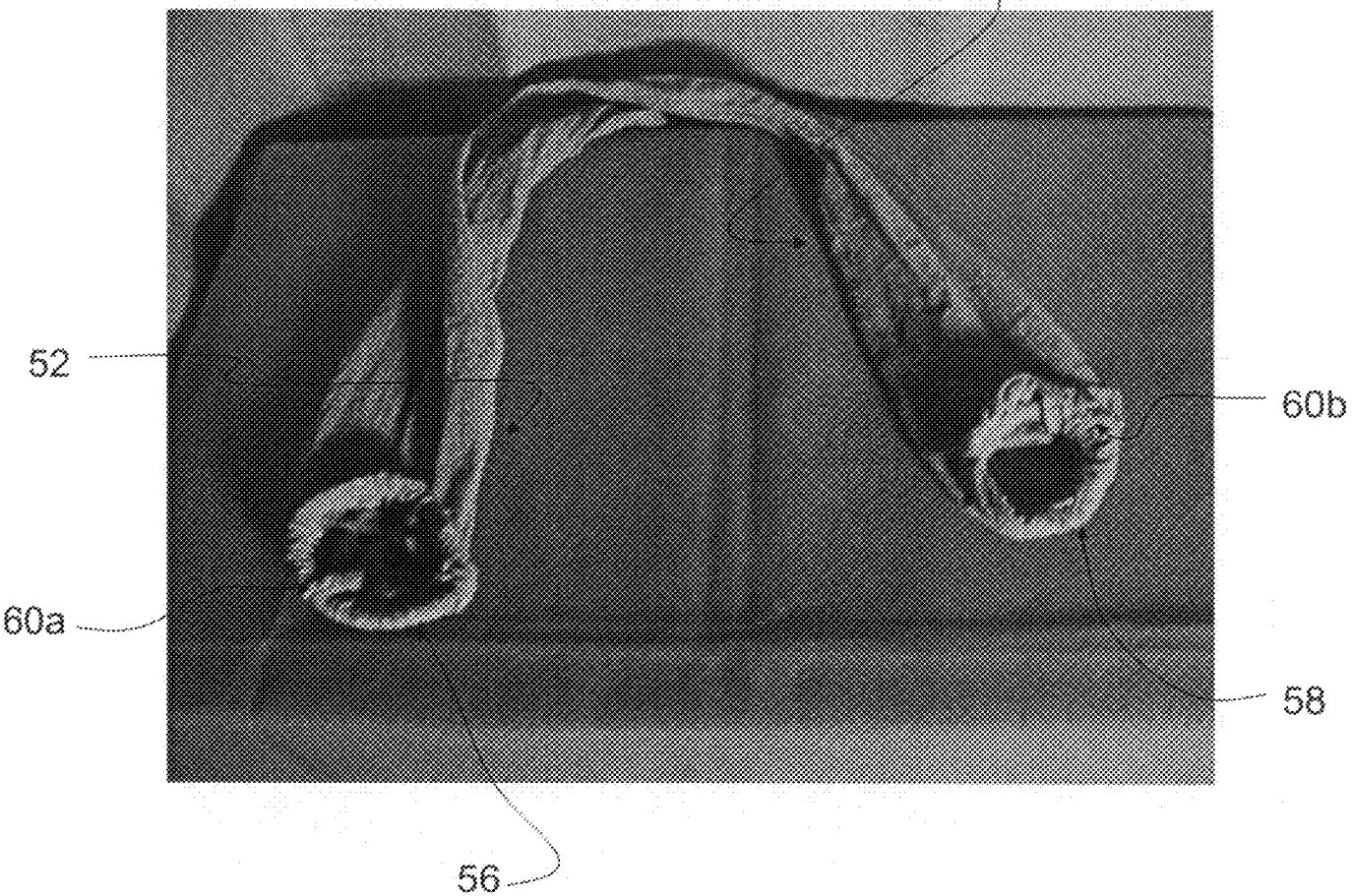
FIG. 3 is a view of a flexible tube for facilitating the passage of hair through the aperture of a helmet.
Figure 4:
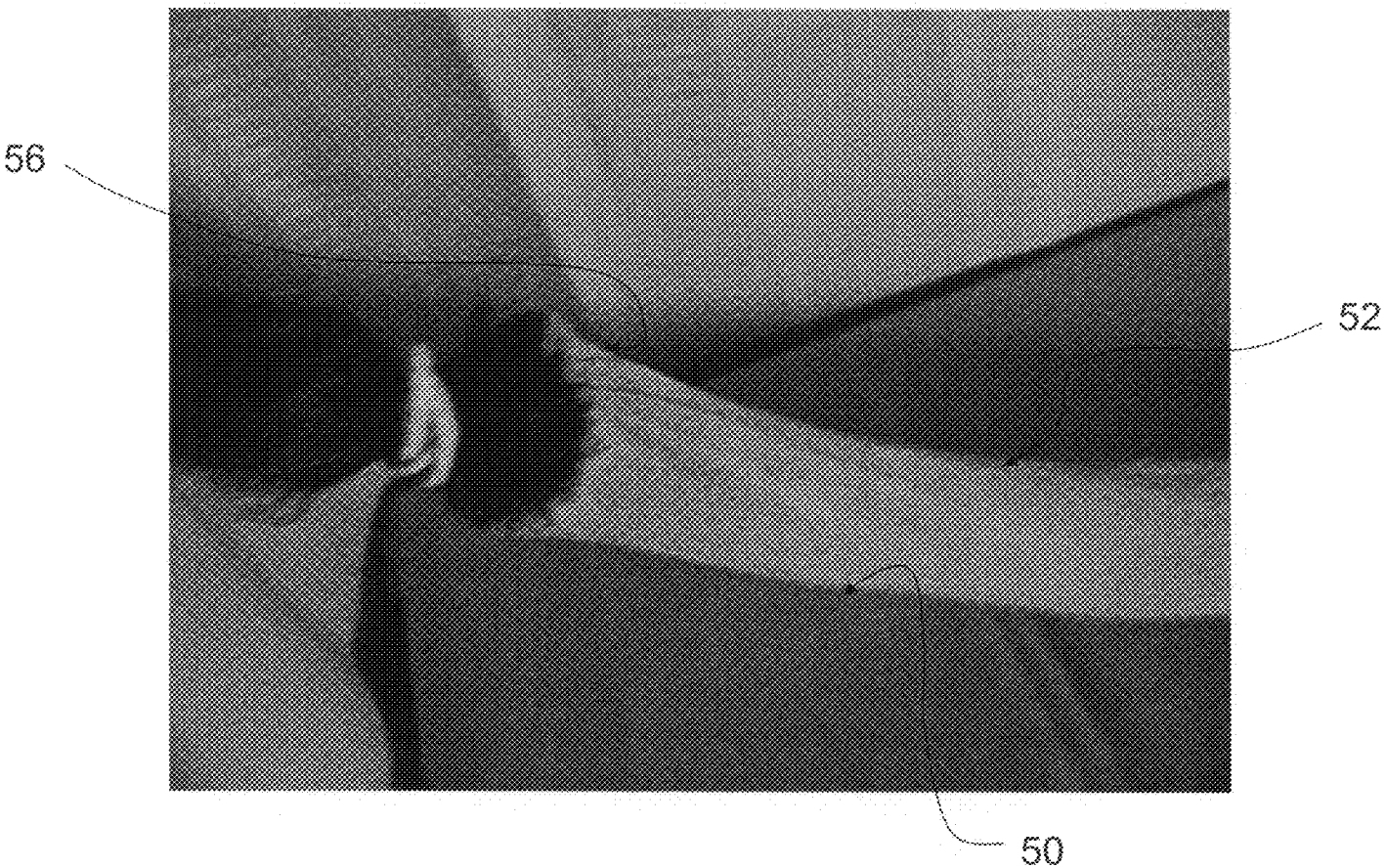
FIG. 4 depicts an associated person's hair inside the flexible tube.

With reference now to FIG. 3, there is shown an apparatus 50 for facilitating the passage of hair through the aperture 14. The apparatus 50 comprises a flexible tube member 50 having first and second ends 60*a*, 60*b*. The tube member 50 is preferably hollow, having open first and second ends 60*a*, 60*b*. The flexible tube member 50 may be an elastic tube or otherwise constructed from an elastic material, which may be nylon. In one embodiment, the flexible tube member 50 may be a segment of hose or stockings, such as are commonly worn by women. In another embodiment, the flexible tube member 50 may be a segment of a sock, which may be a nylon or cotton sock. In yet another embodiment, the flexible tube member 50 may be a segment from a pair of commonly worn tights. However, it will be recognized the flexible tube member 50 may be constructed from any natural or synthetic material having flexible properties, with the preferred materials being natural or synthetic fabrics, such as nylon or cotton or polyester, or rayon.

The flexible tube member 50 may have a length, that, in an unstretched state is from about 8 to about 15 inches. The length of the flexible tube member 50 is not essential, though it will preferably be long enough, in either or both its stretched or unstretched states, to encapsulate the length of the associated user's ponytail, while leaving sufficient length to feed the second end 60*b* of the flexible tube member 50 fully through the aperture 14, in the manner described below.

With continued reference to FIG. 3 the flexible tube member 50 may further include an elastic band member 56, 58 operatively affixed at one or both of the first and second ends 60*a*, 60*b* of the flexible tube member 50. The elastic band members 56, 58 may be integrally fixed at the first and second ends 60*a*, 60*b* of the flexible tube member 50. In another embodiment, the elastic band members 56, 58 may be secured, such as by adhesive or mechanical means, such as sewing, to the first and second ends 60*a*, 60*b* of the flexible tube member 50. The presence of the elastic band members 56, 58 will preferably, though not necessarily, serve to reduce the diameter of the first and second ends 60*a*, 60*b* of the flexible tube member 50 so that the first and second ends 60*a*, 60*b* of the flexible tube member 50 can be removable secured around the associated user's ponytail or fixture as described below. The elastic band members 56, 58 may be rubber bands, which may be sewed or adhesively affixed about the respective openings defined by the first and second ends 60*a*, 60*b* of the flexible tube member 50. It will be understood that the elastic band members 56, 58 may be of any material selected with sound engineering judgment. In an alternative embodiment, not shown, the respective diameters of the first and second ends 60*a*, 60*b* may be restricted by cinching, which may be by means of an elastic or inelastic cord, belt, which may be a hook and loop type belt, or the like. While it is preferable that each of the first and second ends 60*a*, 60*b* of the flexible tube member 50 be provided with elastic band members 56, 58, it may be desirable in some applications, to only modify one end 60*a* with an elastic band member 56, or to select different mechanisms for use in reducing the diameter of the respective first and second ends 60*a*, 60*b*.

Having described the apparatuses for facilitating the passage of hair through the aperture, a method of using the apparatuses will now be described.

A method of facilitating the passage of long hair through a helmet 2 having an aperture 14 fashioned in the rearward portion extending from the inner shell portion 34 to the outer shell portion 32 of the helmet shell 30, includes placing the first end 60*a* of the flexible tube member 50 over an associated user's hair, and more specifically, ponytail, so that the user's ponytail is substantially inside the flexible tube member 50. This may be achieved by many methods. With the helmet 2 off of the user's head, the second end 60*b* of the flexible tube member 50 may be passed through the aperture 14 and/or the channel member 39 of the helmet 2, from inside to outside (i.e., so that the second end 60*b* of the flexible tube member 50 extends outside the helmet 2). With the second end 60*b* of the flexible tube member 50 positioned outside the helmet 2, the helmet 2 may be placed on the associated user's head. The associated user may grab the second end 60*b* of the flexible tube member 50 and pull thereon to draw the flexible tube member 50 and encapsulated ponytail substantially through the aperture 14.

Figure 5:
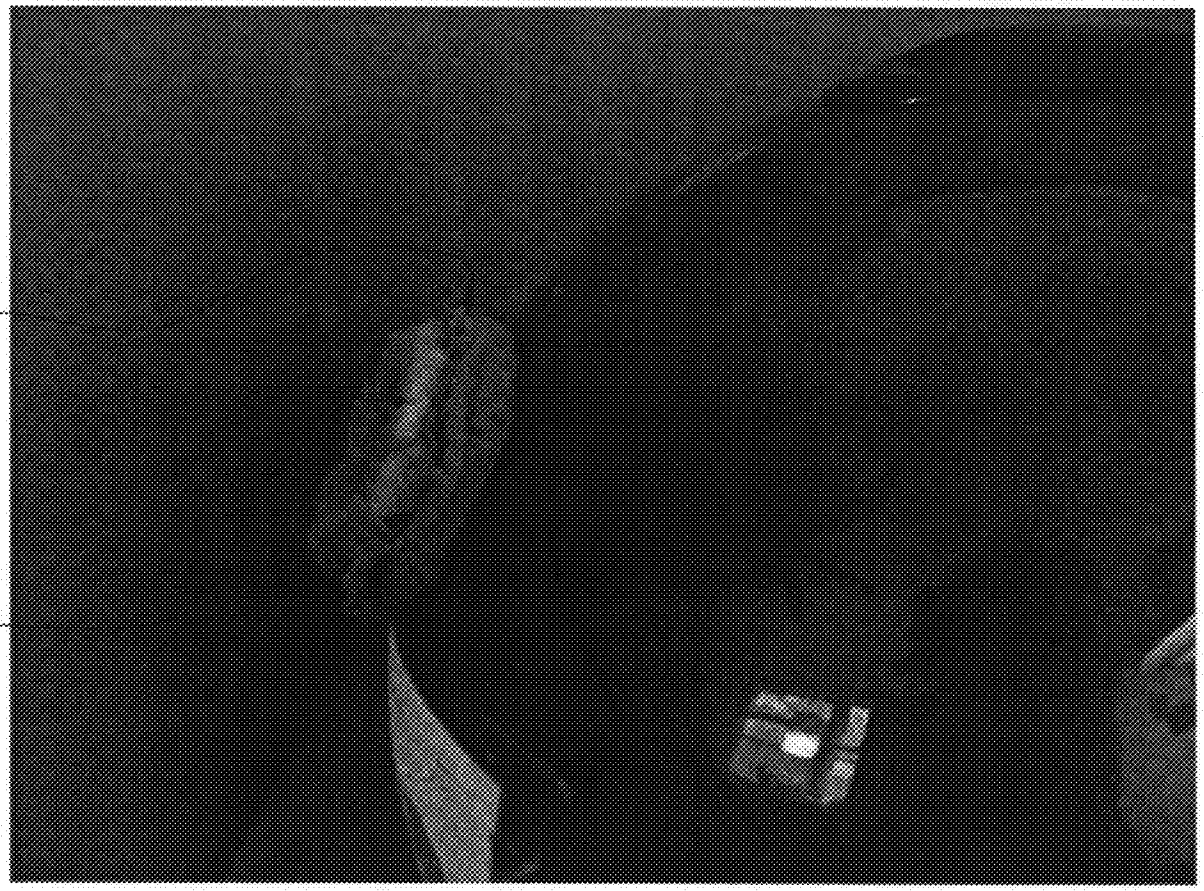
FIG. 5 shows an end of the flexible tube removably secured to a fixture on the helmet.
Figure 6:
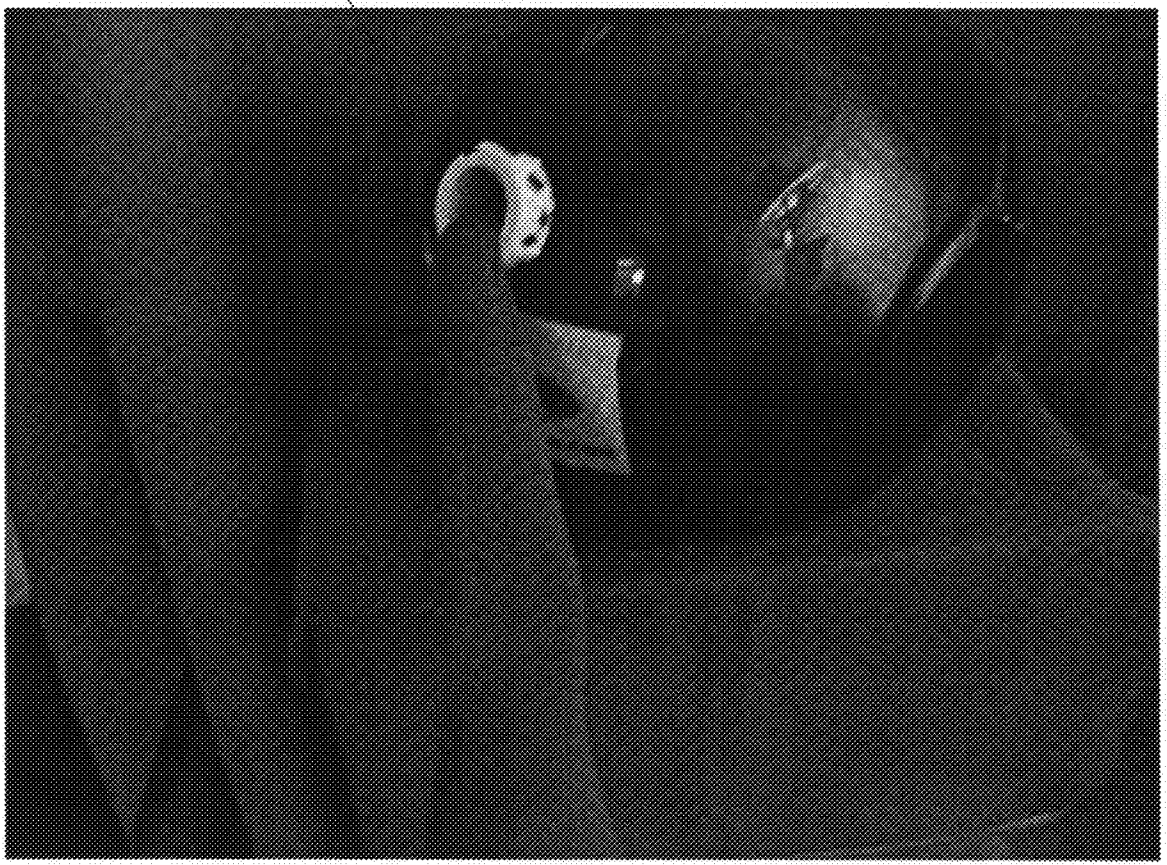
FIG. 6 is a rearward view of hair extending through the rear aperture of a helmet.

In one embodiment, shown in FIG. 5, it may be desirable to removably secure the second end 60*b* of the flexible tube member 50 to a fixture 65 operatively positioned adjacent the aperture 14 on the outer shell portion 32 of the helmet shell 30 after the step of placing the second end 60*b* of the flexible tube member 50 through the aperture 14 of the helmet 2. This may help prevent the second end 60*b* of the flexible tube member 50 from being drawn back through the aperture 14 while the helmet 2 is being put on the associated user's head. In one embodiment, the fixture 65 may be the selectively removable securing ring 65. In this embodiment, the second end 60*b* of the flexible tube member 50 may be placed about the selectively removable securing ring 65, where it may remain substantially in place and accessible until the helmet 2 has been put on. In other embodiments, the fixture 65 may be a hook or clip or portion of hook and loop fabric, which may be removably or substantially permanently affixed to the outer shell portion 32 of the helmet shell 30; however, it will be recognized that any means for removably securing the second end 60*b* of the flexible tube member 50 to the outer shell portion 32 of the helmet 2 may be selected. Also, it will be noted that the fixture 65 may be located anywhere on the outer shell portion 32 of the helmet shell 30, though a position adjacent the aperture 14 is preferred.

It will also be noted that, whereas the distal end 43 of the channel member 39, previously described, may be threaded 44 to receive a selectively removable securing ring 46 having mating threads 48, the selectively removable securing ring 46 may be adapted to serve one or more decorative or safety functions. In the same manner, the fixture 65, if not the selectively removable securing ring, may be adapted to serve one or more decorative or safety functions. For example, the selectively removable securing ring 65 may be adapted with one or more lights, which may be LED lights, powered by a suitable power source, such as a battery affixed to the helmet. Alternatively, the selectively removable securing ring 65 may be adapted with reflective materials, such as a reflective tape that will reflect light from a vehicle's headlights. Still in another embodiment, the selectively removable securing ring may be adapted with various jewels, crystals so as to function as a design element on the helmet 2.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A method of putting on a safety helmet comprising the steps of:

providing a helmet, the helmet comprising:

a helmet shell having an outer and an inner surface, the helmet shell having an inner core positioned between the outer surface and the inner surface, the helmet shell having a frontal portion and a rearward portion, the helmet shell having a first opening for use in fitting the helmet over an associated person's head, the helmet shell having a front visual access section fashioned at the frontal portion of the helmet shell for use in allowing the associated user to see out from the helmet shell;

an aperture fashioned in the rearward portion of the helmet extending from the inner surface to the outer surface of the helmet shell;

a generally tubular channel member having a flange fashioned at a first end of the channel member, the channel member being operatively received within the aperture and wherein the channel member includes a second end, wherein the second end of the channel member includes a threaded portion fashioned on the outer surface of the channel member; and a ring member having a threaded inner surface for use in securing the channel member to the safety helmet;

providing a flexible, hollow tube member having first and second ends;

placing the flexible tube member over an associated user's ponytail so that the ponytail is substantially inside the flexible tube member;

passing the second end of the flexible tube through the aperture, from inside to outside so that at least a portion of the flexible tube extends outside the helmet adjacent the aperture;

placing the helmet on the associated user's head; and pulling on the second end of the flexible tube to draw the flexible tube substantially through the aperture.

2. The method of claim 1, wherein the helmet further comprises:

securing means for use in securing the helmet to the associated user.

3. The method of claim 2, wherein the helmet further comprises:

a transparent safety shield connected to the helmet shell at the front visual access section, wherein the transparent safety shield substantially covers the front visual access section.

4. The method of claim 1, wherein the flexible, hollow tube member further comprises:

a first elastic band member operatively affixed to the first end of the flexible, hollow tube member.

5. The method of claim 4, wherein the flexible, hollow tube member further comprises:

a second elastic band member operatively affixed to the second end of the flexible, hollow tube member.

6. The method of claim 5, wherein following the step of passing the second end of the flexible tube through the aperture, from inside to outside so that at least a portion of the flexible tube extends outside the helmet adjacent the aperture, the method further comprises the step of:

removably securing the second end of the flexible tube to the ring member.

7. The method of claim 1, wherein the flexible tube is elastic.

8. The method of claim 7, wherein the flexible tube is nylon.

* * * * *